United States Patent [19]

Schachter

[11] 3,976,199

[45] Aug. 24, 1976

[54] PORTABLE CURRENCY DETECTOR

[75] Inventor: Jacob Schachter, Huntington, N.Y.

[73] Assignee: Ketek Electric Corporation, Huntington, N.Y.

[22] Filed: Mar. 17, 1975

[21] Appl. No.: 558,904

[52] U.S. Cl. ..... 209/111.8; 209/DIG. 2

[51] Int. Cl.[2] ..... B07C 3/16

[58] Field of Search ..... 209/DIG. 2, 111.8; 194/4 R, 4 B, 4 C, 4 D, 4 E, 4 G; 324/34 R

[56] References Cited

UNITED STATES PATENTS

| | | | |
|---|---|---|---|
| 3,256,984 | 6/1966 | Ptacek | 194/4 E X |
| 3,509,535 | 4/1970 | Berube | 209/111.8 X |
| 3,706,027 | 12/1972 | Grice et al. | 209/111.8 X |
| 3,715,031 | 2/1973 | Okkonen | 209/111.8 X |

*Primary Examiner*—Robert B. Reeves
*Assistant Examiner*—Joseph J. Rolla
*Attorney, Agent, or Firm*—Charles E. Temko

[57] ABSTRACT

A portable battery-powered device for verifying genuine currency based on the characteristic of United States and certain foreign currencies that some portion of the bill is printed with ink having magnetic properties. The device employs a tuned pickup head and correspondingly tuned narrow band regenerative amplifier using frequencies corresponding to those generated by sensing the engraving present along the longer edges of the currency when manually drawn past the pickup head.

1 Claim, 6 Drawing Figures

PORTABLE CURRENCY DETECTOR

BACKGROUND OF THE INVENTION

Magnetic sensing of currency is not new, and the art is highly developed. One device, described in the U.S. Pat. No. 3,180,491 includes means for advancing successive bills past a sensor at a substantially uniform rate, whereby the signals generated by examining the centrally disposed portrait may be compared with those of a genuine bill. Others are equally complicated, and are designed principally for use in financial institutions where a large volume of currency is examined on a daily basis. Such devices are now only incapable of being conveniently transported, but, because of mechanical complexity, are extremely expensive to manufacture.

SUMMARY OF THE INVENTION

Briefly stated, the invention contemplates the provision of a portable battery-powered device of the class described which is small enough to fit in a pocket, purse, or to be chained to a cash register so that it will be readily available for use anywhere that cash transactions may occur. The device includes a permanent magnetic mounted at one end of the instrument adjacent a magnetic pickup, and a resilient clip supporting the edge of the bill being examined, so that it may be manually grasped at one end thereof and smartly pulled past the magnetic and pickup. Because of the nature of the engraving occurring along the longer longitudinal edges of the bill, the signal generated varies in frequency from approximately 500 Hz. to 2500 Hz., the bulk of the signals being normally generated in the order of 1000 Hz. The inductance of the pickup head is tuned by a capacitor to approximately the last mentioned frequency. This tuning accomplishes two functions. Firstly, it reduces the bandwidth resulting in lower signal-to-noise ratio. Secondly, the reduced bandwidth enables higher gain from an active element with a limited-gain bandwidth product. The output of the tuned circuit is applied to a noninverting input of an integrated circuit differential amplifier, which amplifies the signal to a level high enough to trigger a silicon-controlled rectifier, the triggering of which results in the activation of a signalling device.

Because of the very low magnetization of the ink, the amplification required is in the order of 100,000. Inexpensive differential or operational amplifiers are not capable of so high a gain at 1000 Hz, and are more likely to provide amplification of 1000 at this frequency. In order to provide the additional gain, without the use of additional active elements, positive feedback is employed. Ordinarily, positive feedback could not be used because of the resulting narrow bandwidth. However, because of the tuning of the pickup, the narrow bandwidth becomes acceptable. This feedback is manually controllable, to result in convenient adjustment of sensitivity, and preventing oscillation.

BRIEF DESCRIPTION OF THE DRAWING

In the drawing, to which reference will be made in this specification, similar reference characters have been employed to designate corresponding parts throughout the several views.

DETAILED DESCRIPTION OF THE DISCLOSED EMBODIMENT

Figure 1:
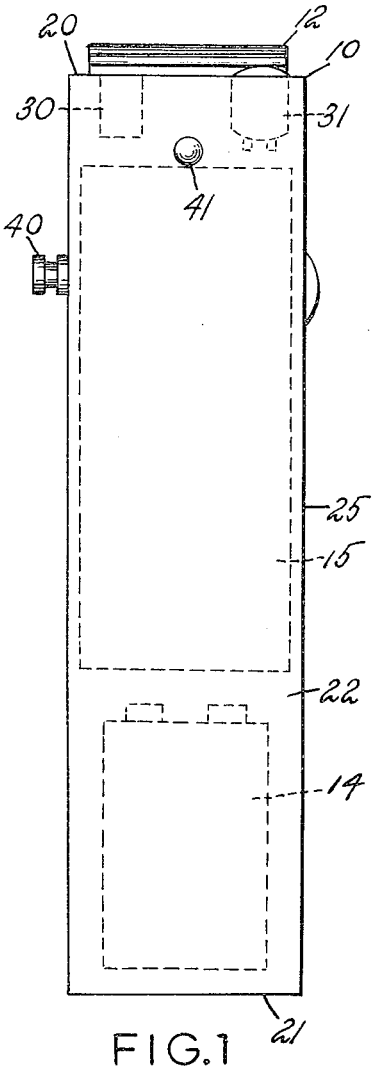
FIG. 1 is a schematic side elevational view of an embodiment of the invention.
Figure 2:
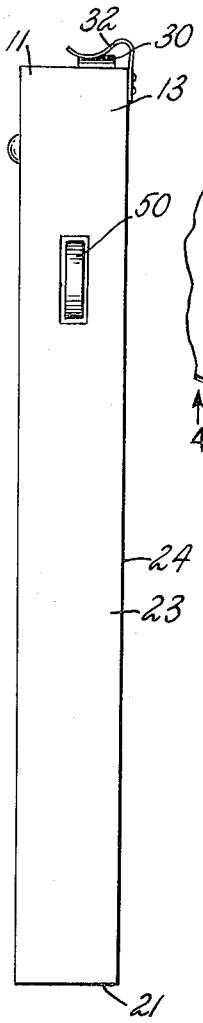
FIG. 2 is a schematic side elevational view of the embodiment as seen from the right hand portion of FIG. 1.
Figure 3:
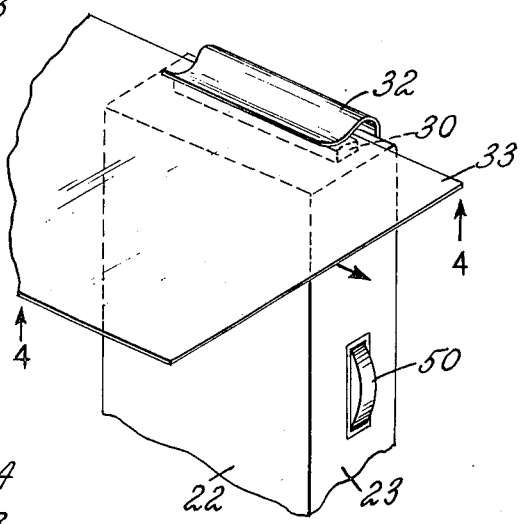
FIG. 3 is a fragmentary view in perspective showing the device in use.
Figure 4:
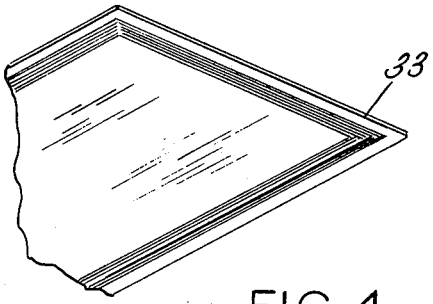
FIG. 4 is a fragmentary view in perspective showing the peripheral engraving present on United States and certain foreign currencies.

In accordance with the first embodiment of the invention, the device, generally indicated by reference character 10, comprises broadly: a casing element 11, a currency engaging element 12, self-contained power source 14, and detector circuitry 15.

The casing element 11 is preferably formed from synthetic resinous material as a molding operation, and includes first and second walls 20 and 21, respectively, and side walls 22, 23, 24 and 25.

The currency engaging element 12 is located at and upper end 13 of the casing element 11, and includes a permanent magnet 30 and an adjacent pickup element 31, both of which are well known in the art. A spring lip or clamp 32 overlies the exposed ends of the magnet 30 and pickup 31, and serves to resiliently clip the edge of a bill 33 thereagainst. Because of its length, the lip also serves as a guide during movement of the bill past the magnet and pickup.

The self-contained power source 14 is preferably in the form of a conventional 9 volt battery used for powering many portable electronic instruments. While it may be of a rechargeable type, conventional non-rechargeable types will normally provide sufficient power for approximately four months average use without difficulty.

Figure 5:
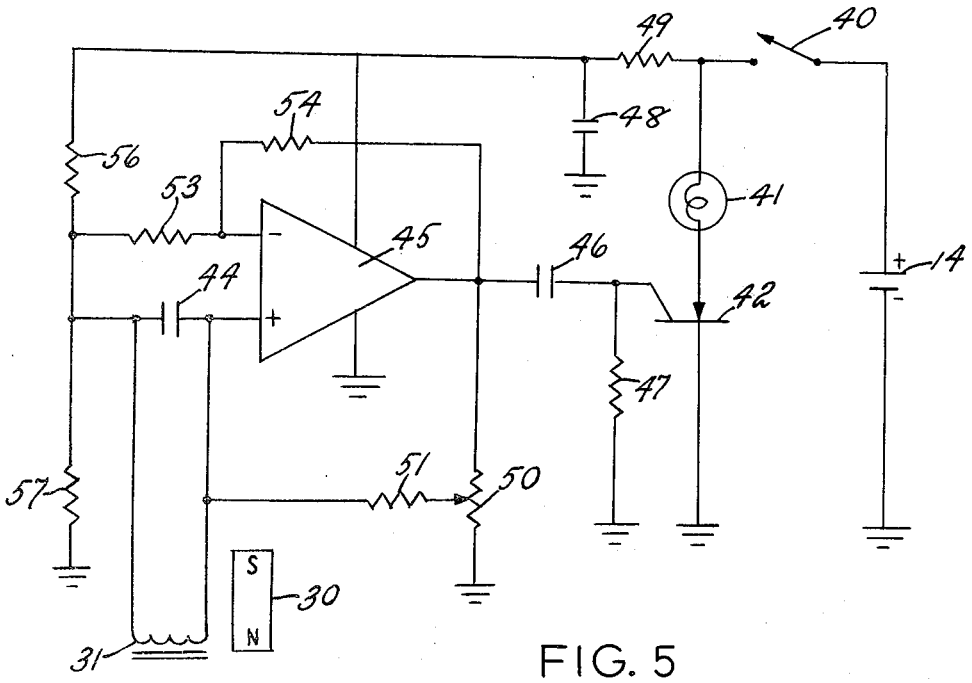
FIG. 5 is a schematic electrical wiring diagram.

The detector circuitry 15 is best understood from a consideration of FIG. 5 in the drawing, and includes a manually operated momentary switch 40 which interconnects power to the remaining members of the circuit. Closing the switch brings current to a series-connected 8 volt lamp 41 which illuminates upon the firing of a silicon-controlled rectifier 42. The pickup 31 is tuned to approximately 1000 Hz. by a parallel-connected capacitor 44. The output of the pickup is coupled to the input of an integrated circuit amplifier 45 in turn coupled through capacitor 46 to the silicon-controlled rectifier 42. Resistor 47 connects this portion of the circuit to ground.

If power were to be suddenly applied to the amplifier 45, an output transient would result which would be coupled through capacitor 46 and resistor 47 to result in an undesirable conduction in the silicon-controlled rectifier 42. This is prevented by a time constant circuit formed by capacitor 48 and resistor 49 which cause power to be applied slowly when the switch 40 is closed.

Feedback to the amplifier 45 is accomplished by resistors 50 and 51. Control of the feedback is by manually adjustable potentiometer 50 and resistor 51. Resistors 53 and 54 provide negative feedback for stabilizing the d-c characteristics of the differential amplifier. This is necessary to prevent the amplifier from saturating due to small drifts which are magnified both by the high gain of the amplifier at d-c and by the presence of the positive feedback. Like other differential amplifiers, amplifier 45 ordinarily requires a positive and a negative voltage supply. In a small compact device, it is desirable to use only a single power supply. This is accomplished by the use of resistors 56 and 57 which set the d-c level of the inputs at approximately one half of the supply voltage. With respect to the input, ground is then as far negative as the other end of the battery is positive.

DESCRIPTION OF OPERATION

When held in the left hand, the left thumb of the user is normally in position to easily press the momentary switch 40, which energizes the device. A suspected bill, held in the right hand, is then inserted between the spring clip 32 and the exposed surfaces of the magnet 30 and pickup 31. The bill may then be pulled from left to right at approximately the speed employed in striking a match. The speed is not critical, nor need it be particularly uniform. If the bill has been printed with magnetic ink, a signal will be generated, resulting in illumination of the lamp 41. Releasing the switch 40 resets the silicon-controlled rectifier 42, thereby resetting the device for a subsequent test.

Because the supply voltage varies over the useful life of the battery, the device will occasionally require recalibration. This is accomplished by energizing the unit, and adjusting the potentiometer 50 until the lamp 41 just becomes illuminated. The switch 40 is then released, and the potentiometer turned back slightly. The calibration may be checked at any time by testing a bill known to be genuine. A one dollar bill may be used for this purpose, since this denomination is rarely counterfeited.

It will be observed that while manually pulling the bill past the magnet and pickup, it is practically impossible to perform the operation at a completely uniform speed from start to finish. During the course of this motion, the signal generated will invariably at some point correspond to the narrow band tune frequency of the pickup. Therefore, a wide band pickup is not required, and the use of a narrow band tuned pickup permits a single stage of amplification with controlled regeneration, thereby materially simplifying the necessary circuitry.

Figure 6:
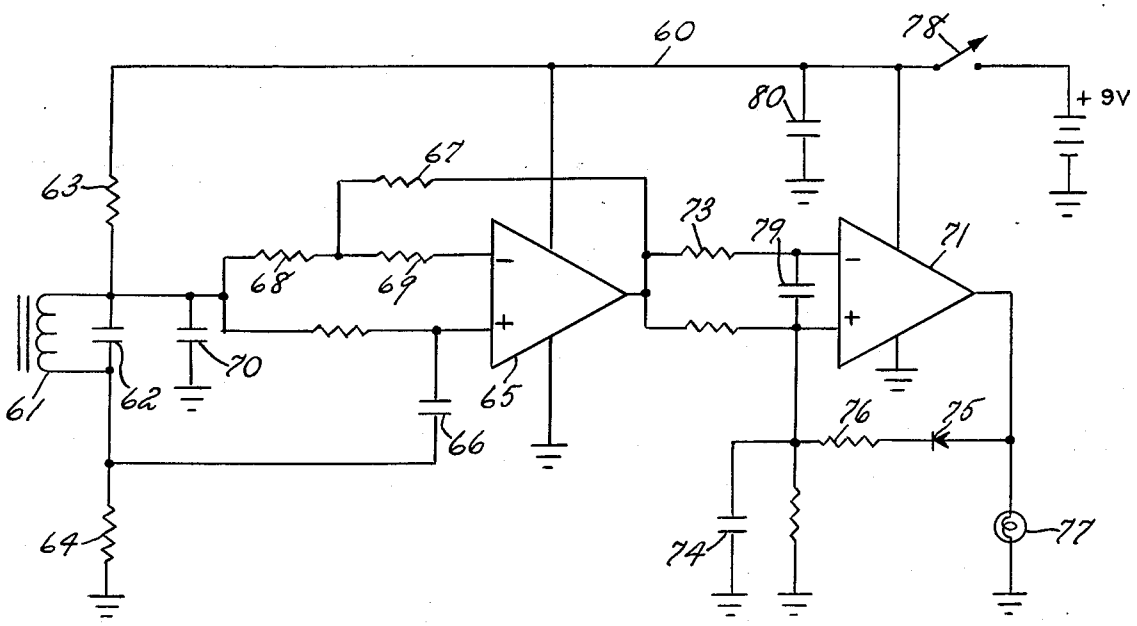
FIG. 6 is a schematic electrical wiring diagram of a second embodiment of the invention.

Turning now to the second embodiment of the invention, schematically illustrated in FIG. 6, certain modifications are incorporated that change both the method of use and the electronic circuitry. These changes result in both advantages and disadvantages as compared to the first embodiment.

The second embodiment incorporates two important changes that are immediately apparent to the user. The first is the elimination of the sensitivity control so that the only remaining control is an off-on switch. The second change is the elimination of the spring clip which makes it simpler to rub the bill across the head, these changes resulting in simplification of the operation of the device to an unskilled user.

A third change which is not immediately apparent is a substantially improved resistance to noise impulses which may cause false indication of the presence of a good bill, when in fact it should not. This is achieved by the addition of an integrating circuit which requires a proper signal over a period of time rather than relaying on a single impulse which may emanate from a spurious source.

Referring to FIG. 6, the second embodiment is indicated generally by reference character 60. The magnetic field of the currency is detected by a sensor 61 which is tuned to approximately 1000 Hz by the capacitor 62. Bias current through the sensor, set by resistors 63 and 64, provide a d-c field so that a permanent magnet is not required as in the case of the first embodiment. The output of the sensor 61 is coupled to an integrated circuit operational amplifier 65 by means of coupling capacitor 66. The gain of amplifier 65 is stabilized by negative feedback through the resistor network comprising resistors 67, 68 and 69. A capacitor 70 provides power supply decoupling.

The output of amplifier 65 is directly coupled to an integrated circuit comparator 71. Four functions are provided by this stage, namely amplification, integration, latching and output driver.

Current flowing through resistors 72 and 73 sets a bias level at the input to comparator 71. When the signal from amplifier 65 exceeds this level, comparator 71 conducts causing its output, which is normally at ground potential, to become positive. This, in turn, causes capacitor 74 to change through diode 75 and resistor 76. Capacitor 74 thus acts as an integrating circuit when comparator 71 is conducting. If there is a signal of sufficient amplitude for comparator 71 to conduct, and it remains for a sufficient time so that capacitor 74 adequately charges, the output voltage of capacitor 74, which is applied to the positive feedback input terminal of comparator 71, will cause comparator 71 to "latch" in the conducting condition. Thus, indicator lamp 77 will be illuminated, and remain in this condition as long as the momentary switch 78 is kept closed. The circuit will automatically reset when the switch is released.

The amount of integration, and therefore the degree of noise immunity, is controllable by means of the time constant formed by capacitor 74 and resistor 76. Capacitors 79 and 80 are used to provide stability against spurious oscillations.

I wish it to be understood that I do not consider the invention limited to the precise details of structure shown and set forth in this specification, for obvious modifications will occur to those skilled in the art to which the invention pertains.

1. A portable self-powdered currency detector device comprising: a casing element, a narrow band pickup projecting outwardly of said casing element, a narrow band regenerative amplifier disposed within said casing element, and connected to and receiving the output of said pickup, electrically powered indicator means carried by said casing element, and comparator means actuated by the output of said amplifier in series with said indicator means; whereby upon the positioning of a bill printed with a magnetic ink upon said pickup, and the manual rectilinear movement of the same past said pickup, a signal is generated of varying frequency, at least a part of which corresponds to the tuned frequency of said pickup said comparator receiving the output of said amplifier; said device including a resistor setting a bias level at the input to said comparator, an integrator receiving the output of said comparator above a bias level, and feedback means incorporated into said comparator for latching said comparator in conducting condition to operate said indicator means when a valid bill is presented.

* * * * *